US008061276B2

(12) United States Patent
Danon et al.

(10) Patent No.: US 8,061,276 B2
(45) Date of Patent: Nov. 22, 2011

(54) NON-LETHAL PROJECTILE

(75) Inventors: Haim Danon, Kiriat Ono (IL); Ilan Shalev, Givataim (IL)

(73) Assignee: SDI—Security Device International Inc., Bney Braq (IL)

( * ) Notice: Subject to any disclaimer, the term of this patent is extended or adjusted under 35 U.S.C. 154(b) by 0 days.

(21) Appl. No.: 12/952,335

(22) Filed: Nov. 23, 2010

(65) Prior Publication Data

US 2011/0061557 A1 Mar. 17, 2011

Related U.S. Application Data

(63) Continuation of application No. 12/059,064, filed on Mar. 31, 2008, now Pat. No. 7,861,657.

(60) Provisional application No. 60/909,461, filed on Apr. 1, 2007.

(51) Int. Cl.
*F42B 12/02* (2006.01)

(52) U.S. Cl. ..... 102/502; 473/569

(58) Field of Classification Search ..... 102/501, 102/502, 513, 529; 473/569, 579, 614
See application file for complete search history.

(56) References Cited

U.S. PATENT DOCUMENTS

| | | | | |
|---|---|---|---|---|
| 4,008,667 | A * | 2/1977 | Look | 102/502 |
| 4,770,423 | A * | 9/1988 | Pinske | 473/580 |
| 5,565,649 | A * | 10/1996 | Tougeron et al. | 102/502 |
| 6,315,687 | B1 * | 11/2001 | Todd et al. | 473/579 |
| 6,619,211 | B1 * | 9/2003 | Haeselich | 102/513 |
| 7,434,517 | B1 * | 10/2008 | Linker | 102/502 |
| 7,861,657 | B2 * | 1/2011 | Danon et al. | 102/502 |
| 2004/0069177 | A1 * | 4/2004 | Klein | 102/502 |
| 2006/0086280 | A1 * | 4/2006 | Duong | 102/502 |
| 2006/0276277 | A1 * | 12/2006 | Montefusco | 473/586 |
| 2007/0137085 | A1 * | 6/2007 | Aske | 42/70.11 |

* cited by examiner

*Primary Examiner* — Bret Hayes
(74) *Attorney, Agent, or Firm* — The Law Office of Michael E. Kondoudis

(57) ABSTRACT

A projectile is provided for use in a non-lethal weapon system. The projectile includes a first body with a longitudinal axis. The projectile having kinetic energy is launched substantially along the longitudinal axis in the direction of a target. The projectile preferably includes a second body with the same longitudinal axis and a hollow. A portion of the first body fits marginally within the hollow. The elastic mechanism includes an elastic deformation of the first body and/or second body while the first body is forced into the hollow during the impact.

5 Claims, 10 Drawing Sheets

NON-LETHAL PROJECTILE

CROSS REFERENCE TO RELATED APPLICATIONS

The present application is a continuation of U.S. patent application Ser. No. 12/059,064, now U.S. Pat. No. 7,861,657 now allowed, which was filed on Mar. 31, 2008, which claims the benefit of priority from U.S. provisional application No. 60/909,461, which was filed on Apr. 1, 2007, the disclosures of which are incorporated herein by reference.

FIELD AND BACKGROUND

The present invention relates to a projectile used for incapacitation of a human being or animal target and more specifically mechanisms for absorbing kinetic energy of the non-lethal projectile.

Conventional weapons are used by law enforcement personnel to deter and subdue criminals. However, the use of conventional weapons by the law enforcement personnel is limited by the possibility of inflicting injury to an alleged suspect, since the courts and not law enforcement personnel have the responsibility for determining guilt and sentencing a criminal. Even worse the use of conventional weapons by law enforcement personnel may lead to a tragic injury or death of an innocent bystander. Furthermore, non-lethal weapons are required for controlling crowds in violent demonstrations.

A non-lethal weapons system is used to incapacitate as opposed to inflict injury in order to prevent suspect targets from fleeing, engaging in further combat, or committing other criminal acts. Conventional non-lethal weapons include billy clubs (or batons) rubber and plastic bullets. Batons as used by the law enforcement officers are wielded in close range and are capable of inflicting serious physical trauma. Rubber and plastic bullets are typically too energetic to be used at distances less than about 25 meters and become ineffective at distances greater than 50 meters. Conventional rubber and plastic bullets have caused a significant number of unwanted injuries.

U.S. Pat. No. 3,710,720 discloses a weapon system including a launcher and a flexible low lethality projectile of relatively large mass adapted to be radially expanded during trajectory so as to present a relatively large impact surface to the target. The projectile has an initial relatively small cross section so as to be insertable in a conventional launcher. The launcher has internal rifling grooves within the barrel to effect rotation of the projectile and radial expansion thereof due to centrifugal force. The relatively large area of contact on impact reduces energy per unit area penetration of the target while maintaining high inertia energy.

U.S. Pat. No. 6,012,295 discloses a baton projectile including a case of low density polyethylene, and a core of a soft material such as a thermoplastic gel modified rubber. At higher than acceptable impact forces, the case ruptures and the core spreads out to radially disperse the excess impact energy and to present a larger impact area to the target so that the risk of unacceptable penetration and trauma injury to the target is reduced.

The term "target" as used herein refer to the person or animal being incapacitated. The term "outward" as used herein referring to a non-lethal projectile includes a direction with a significant radial component pointing away from the longitudinal axis of the projectile.

The term "viscoelasticity" as used herein describes materials that exhibit both viscous and elastic characteristics when undergoing deformation.

The term "energy density" as used herein refers to a kinetic energy impact of a projectile on a target and is defined as the kinetic energy of the projectile divided by the area of the impact, typically given in units of area per square centimeter.

The term "pressure" as used herein refers to the force of impact of a projectile on a target divided by the area of the impact.

BRIEF SUMMARY

According to an aspect of the present invention, a projectile is provided for use in a non-lethal weapon system. The projectile includes a main body with a longitudinal axis and a deformable head attached to the main body. The projectile having a certain kinetic energy is launched along the longitudinal axis in the direction of a target. Upon impact of the projectile with the target, the deformable head deforms viscoelastically. A part of the kinetic energy of the projectile is viscously dissipated and another part of the kinetic energy is absorbed elastically so that the remaining kinetic energy of the projectile on impact with the target is reduced to a non-lethal level. The projectile preferably includes a semi-rigid element. which includes two or more segments connected by foldable portions. The semi-rigid element preferably supports at least in part the deformable head and attaches to the main body. An air gap and/or soft material is preferably disposed between the semi-rigid element and the main body and/or between the semi-rigid element and the deformable head. Upon impact of the projectile with the target, one or more of the foldable portions bends outward or moves outward in response to the impact. One or more separators are preferably embedded into the deformable head. The separators are preferably transversely oriented, substantially perpendicular to the longitudinal axis. Alternatively, multiple longitudinal members are embedded within the deformable head pointing towards the target and substantially parallel to the longitudinal axis. Upon impact, the longitudinal members are bent outward away from the longitudinal axis. The bending outward by the longitudinal members preferably assists in holding the projectile to the target. The longitudinal members optionally include at least one barbed end which pierce and/or attach to the target upon impact. The deformable head is preferably formed at least in part from a silicone rubber polymer raw material without added cross linking agents or other additives. The projectile preferably includes a second body with the same longitudinal axis. The second body includes a hollow. The first body fits marginally within the hollow so that during the impact the first body is forced into the hollow, deforming at least one of the first body or the second body and thereby absorbing another portion of the kinetic energy. The projectile preferably includes an elastic mechanism which on impact absorbs elastically a portion of the kinetic energy which is stored elastically as stored energy within said elastic mechanism. After the initial impact with the target, the elastic mechanism optionally releases the stored energy to the target thus extending the impulse duration at a lower force.

According to another aspect of the present invention, a projectile is provided for use in a non-lethal weapon system. The projectile includes a first body with a longitudinal axis. The projectile having kinetic energy is launched substantially along the longitudinal axis in the direction of a target. Upon impact of the projectile with the target an elastic mechanism absorbs elastically a first portion of the kinetic energy. The elastic mechanism preferably reduces the maximum force that the projectile exerts on the target during the impact. The elastic mechanism initially during the impact absorbs elastically a second portion of the kinetic energy which is stored elastically as stored energy within the elastic mechanism. After the initial impact with the target the elastic mechanism releases the stored energy to the target thus extending the duration of the impulse but at a lower force. Alternatively, a locking mechanism stores the first portion of the kinetic energy within the elastic mechanism; whereby the remaining kinetic energy of the impact is reduced to a non-lethal level of the target. The projectile preferably includes a deformable head attached to the first body. The deformable head is formed from a viscoelastic material which manifests both the elastic mechanism (with the elastic mechanical properties of the viscoelastic material) and further manifests the locking mechanism with the viscous properties of the viscoelastic material. The elastic mechanism preferably includes a spring which is deformed upon the impact, and stores elastically the first portion of the kinetic energy. This stored energy can be optionally delivered later to the target by releasing the locking mechanism. Alternatively or in addition, the projectile preferably includes a second body with the same longitudinal axis and a hollow. A portion of the first body fits marginally within the hollow. The elastic mechanism includes an elastic deformation of the first body and/or second body while the first body is forced into the hollow during the impact. The first body is preferably externally ridged with first ridges and the hollow is internally ridged with matching second ridges. While the first body is forced into the hollow during the impact, the locking mechanism includes locking the first ridges on the second ridges. The first ridges and second ridges are preferably shaped to prevent release of the elastic mechanism. Alternatively, the locking mechanism is performed using a frictional mechanism which dissipates another portion of the kinetic energy as energy of kinetic friction between the first body and the second body.

According to still another aspect of the present invention, there is provided a projectile including the main body, the deformable head which deforms viscoelastically, the semi-rigid element including at least two segments connected by at least one foldable portion thereof and supports at least in part the deformable head and the second body which during the impact the first body is forced into the hollow of the second body, deforming at least one of the first body or the second body and thereby absorbing a portion of the kinetic energy.

The foregoing and/or other aspects will become apparent from the following detailed description when considered in conjunction with the accompanying drawing figures.

DETAILED DESCRIPTION

Figure 1A:
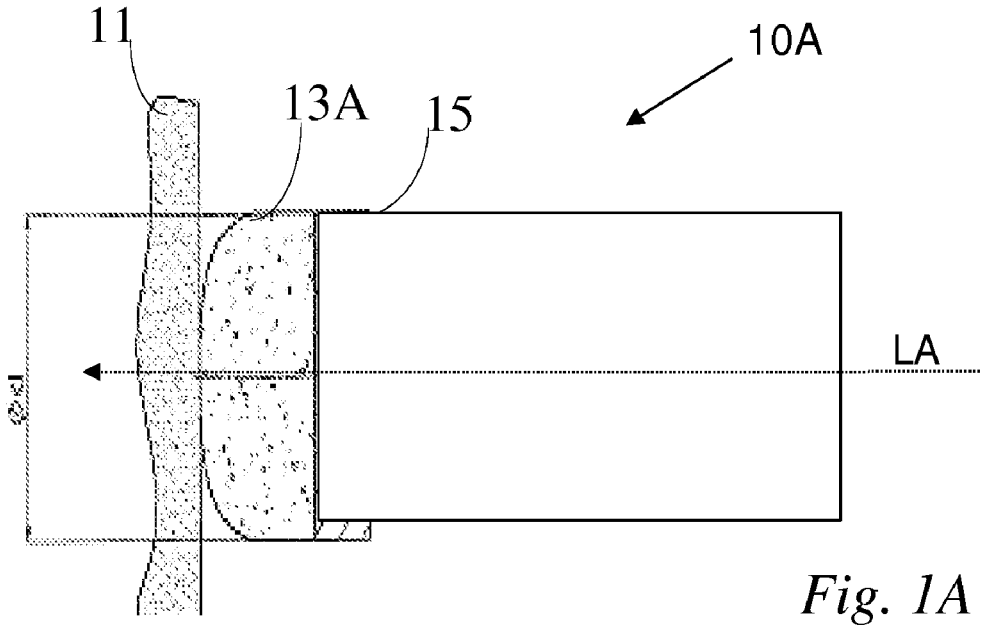
FIGS. 1A and 1B are side views of a non-lethal projectile and the target, according to an embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

Before explaining embodiments of the invention in detail, it is to be understood that the invention is not limited in its application to the details of design and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

By way of introduction, embodiments of the present invention are applicable to projectiles fired at high speed, for example by standard weaponry, e.g. rifle, which carry sufficient kinetic energy to inflict trauma or kill. Projectiles are launched at high speed or high kinetic energy in order to achieve accuracy and range. Absorption of the energy on or just prior to impact according to aspects of the present invention to provide an accurate and non-lethal projectile. Moreover, different embodiments of the present invention may be applied independent of the method of incapacitation used. The incapacitation may be inflicted by different methods including the impact of the projectile and/or by other known methods such as electric shock or administration of drugs, e.g. by needle, or through the air to skin, eyes, and/or respiratory membranes of the target.

Figure 1B:
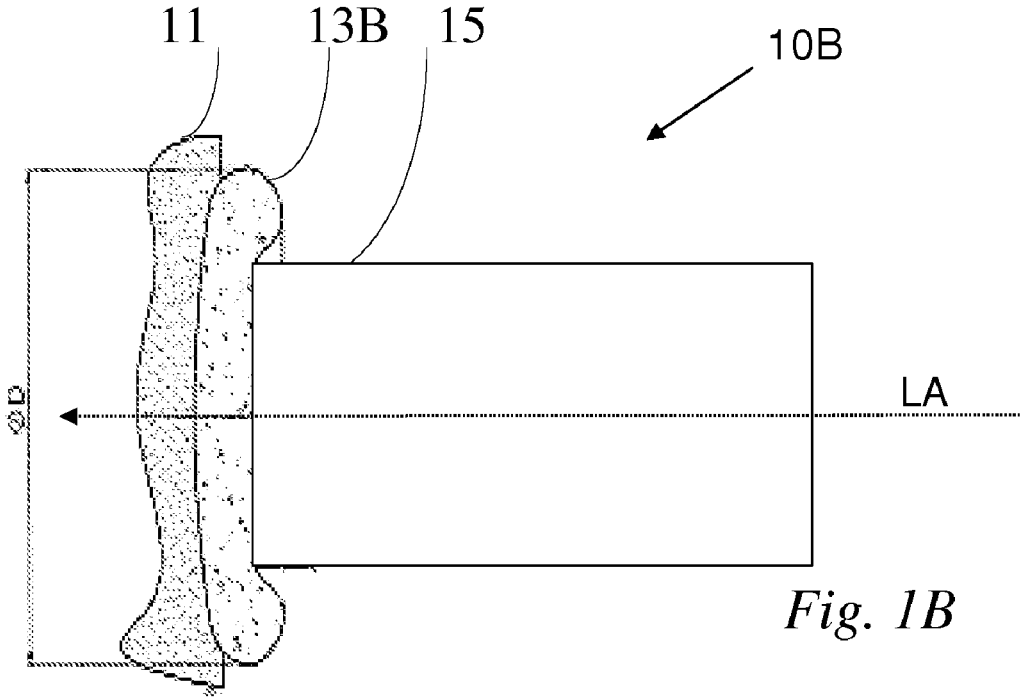

Referring now to the drawings, FIG. 1 is a side view of a non-lethal projectile 10, according to an embodiment of the present invention. FIG. 1A illustrates a non-lethal projectile 10A prior to impact with a target 11 and FIG. 1B illustrates non-lethal projectile 10B after impact with target 11. Non-lethal projectile 10 has a longitudinal axis labeled LA which points in the direction of propagation of projectile 10. A deformable head 13A is shown in FIG. 1A, prior to impact with target 11 as having a diameter d and after the impact, the diameter of deformable head 13B is shown to have a larger diameter D. As illustrated in FIGS. 1A and 1B, when the deformable material of the deformable head 13 is under pressure during impact with target 11, deformable head 13 is smashed between target 11 and projectile 10 and flows transversely (or radially, perpendicular to longitudinal axis LA) and shear forces are developed in the material. The form of the material of deformable head 13 is changed as the material flows beyond its initial form 13A creating the shear layers. The internal shear forces along the movement of the shear layers yields loss of energy. Thus when projectile 10 collides with target 11, the material is pressed, such that at least some of the energy is absorbed in this process and not transferred to target 11 under impact.

A non-limiting list of examples of base materials which may be used for deformable head 13 includes: silicones; fluorosilicones; polyurethanes; polysulfides; polybutylenes (polymers based on C4 monomers); polyvinyl chloride; acrylic resins; vinyl acetate; ethylene vinyl acetate; vinyl acrylic (copolymers of vinyl acetate and alkyl acrylates such as butyl acrylate); styrene butadiene rubber (SBR); styrenic block copolymers; oleoresinous compositions; bituminous; rosin; unsaturated elastomers such as polybutadiene, polyisoprene and polychloroprene; saturated elastomers such as polyisobutylene, ethylene propylenediene monomer rubber (EPDM), ethylene-propylene copolymers (EPR—Ethylene Propylene rubber), nitrile-butadiene rubber, and polybutene; and mineral clays and synthetic clays. Mixture of the above mentioned materials or additives thereto such as powders, colloidal silica, fibers may be used to adjust the mechanical properties, e.g. increase the shear force on impact or increase material shelf life, of the deformable material as is known in the art of materials science. The deformable material is optionally constructed of two or more layers made of different materials with different characteristics of deformability to achieve a specific behavior of deformation. The deformable material is optionally coated to protect the deformable material from environmental conditions or excessive forces during firing or ballistic travel.

In preferred embodiments of the present invention, the material of deformable head 13 is viscoelastic and responds both viscously like putty and elastically like rubber.

The viscous deformation causes some of the kinetic energy of the impact to be dissipated and the elastic deformation allows some of the kinetic energy to be stored elastically in the material. The percentage of the elastic energy in the material depends on the material selected. If it is desired to reduce the bounce of the projectile from the target, elastic energy can be reduced for example to a few percent of the kinetic energy of the projectile.

A preferred raw material used for the deformable head is Bayer Siloprene HV1/401. The material is preferably used not according to manufacturers instructions but without any cross linking agents or other additives. A method for making putty like elastic organo-silicon compositions, which retains shape for an extended period of time, is described in U.S. Pat. No. 3,350,344.

It should be noted the shape that the shape of deformable head 13 can be, by non-limiting example, conical, spheroid, cylindroid, ellipsoid, or aspheric.

Figure 2A:
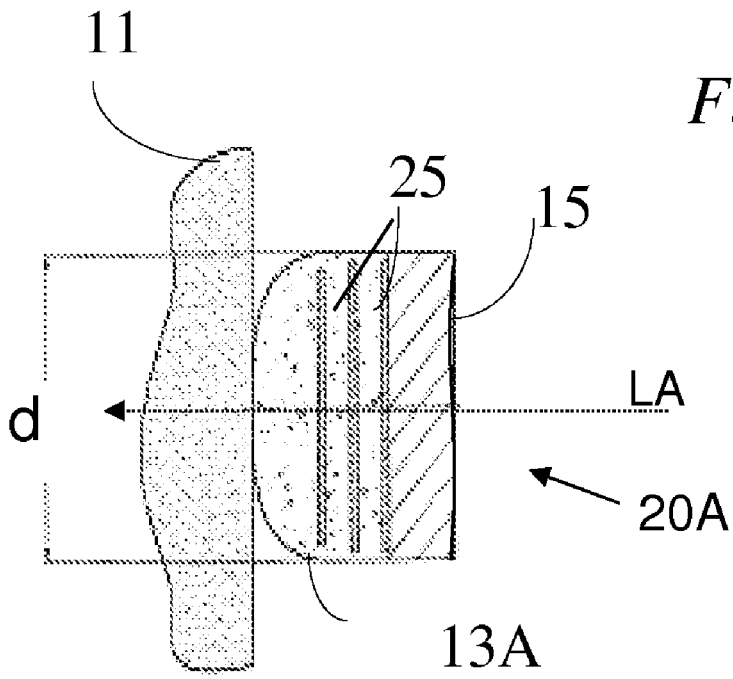
FIGS. 2A and 2B are side views in cross section of a non-lethal projectile and target, according to another embodiment of the present invention.
Figure 2B:
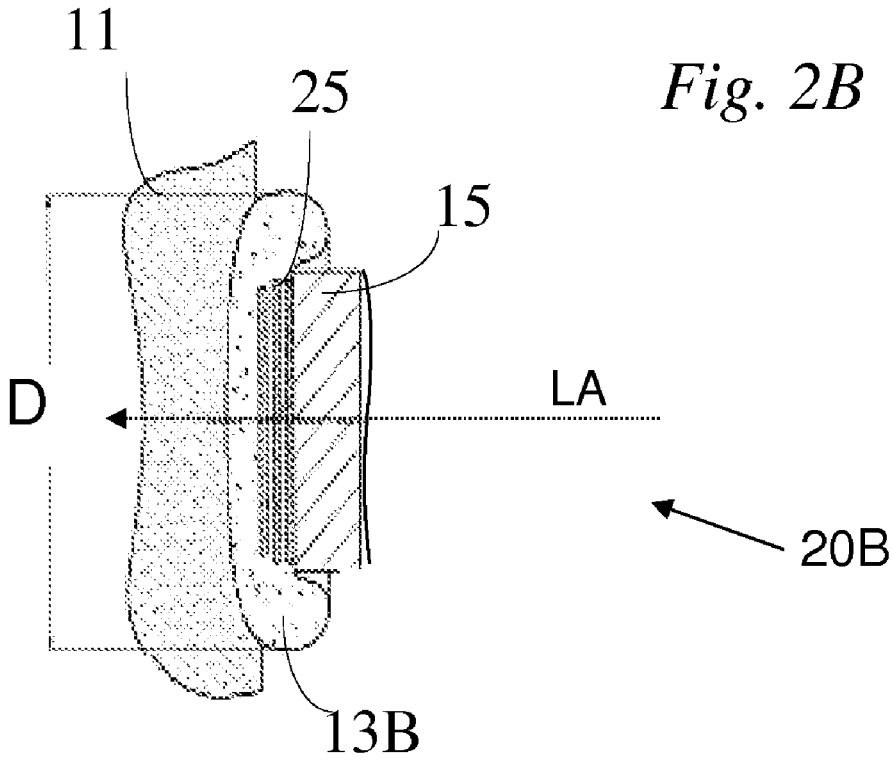

Reference is now made to FIG. 2, a top view in cross section of a non-lethal projectile 20, according to another embodiment of the present invention. FIG. 2A illustrates non-lethal projectile 20A prior to impact with target 11 and FIG. 2B illustrates non-lethal projectile 20B after impact with target 11. A deformable head 13A is shown in FIG. 2A, prior to impact as having a diameter d and after impact, the diameter of deformable head 13B is shown to have a larger diameter D. The diameter D is typically 20% or 30% larger than the diameter d. As illustrated in FIGS. 2A and 2B, when the deformable material of the deformable head 13 is under pressure during impact with target 11, deformable head 13 flows transversely (in radial directions perpendicular to longitudinal axis LA and shear forces are developed in the material.

The magnitude of the shear forces depends on the thickness of the shear layer. Reducing the thickness of the material layer increases the shear forces. Therefore, as illustrated in FIGS. 2A and 2B, separators 25 inserted into deformable head 13 in parallel to the desired shear flow. Separators 25 reduce the thickness of the shear layers thereby increase the force in each of the shear layers. Separators 25 are designed to have good adhesion to the deformable material so as to preferably eliminate slippage between the deformable material and separators 25 during impact. Any movement of separators 25 or bending of separators 25 during impact further reduces impact energy absorbed in target 11.

Figure 3A:
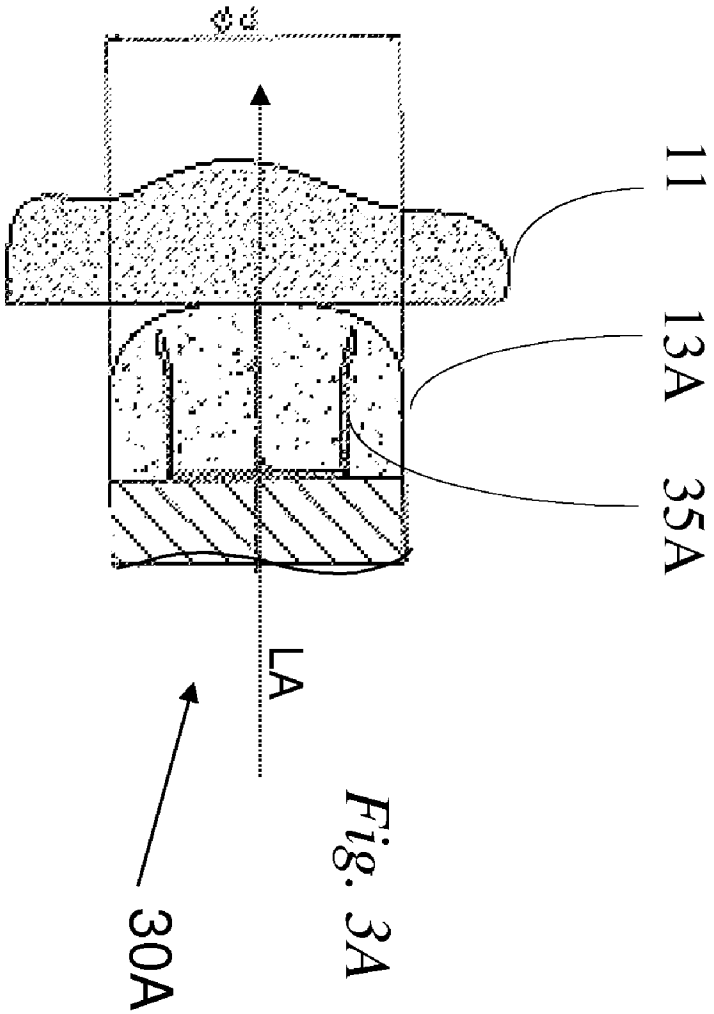
FIGS. 3A and 3B are side views in cross section of a non-lethal projectile and target, according to another embodiment of the present invention.
Figure 3B:
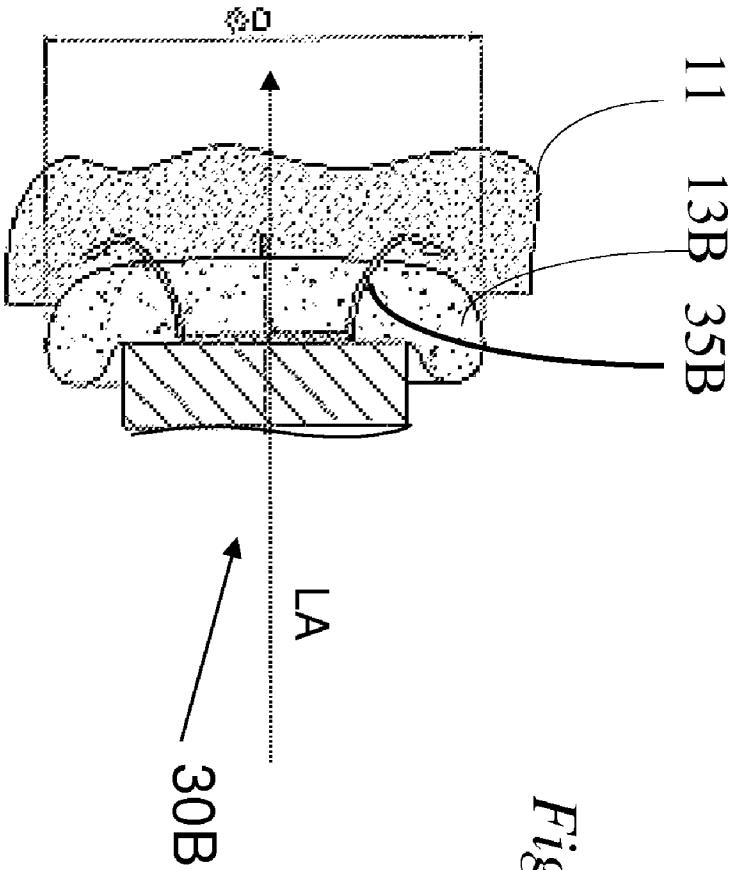

Reference is now made to FIG. 3, a top view in cross section of a non-lethal projectile 30, according to another embodiment of the present invention. FIG. 3A illustrates non-lethal projectile 30A prior to impact with target 11 and FIG. 3B illustrates non-lethal projectile 30B after impact with target 11. Deformable head 13A is shown in FIG. 3A, prior to impact as having a diameter d and after impact, the diameter of deformable head 13B is shown to have a larger diameter D. As illustrated in FIGS. 3A and 3B, when the deformable material of deformable head 13 is under pressure during impact with target 11, the deformable material flows transversely (in radial directions perpendicular to longitudinal axis LA and shear forces are developed in the material. Inserted through deformable head 13A are one or more longitudinal members preferably with barbs at tips 35. Inserts or barbs 35 are directed towards the target and may bend slightly outward. The pressure and shear forces on impact bend barbs 35 outward and through deformable head 13B so that barbs 35B preferably pierce, snag and/or attach the projectile to target 11 on impact. The elastic and/or plastic deformation, i.e. bending of inserts 35 also contribute to the absorption of energy. When inserts 35 deform elastically, the viscous behavior of the deformable material causes the elastic energy to remain stored in bent inserts 35 and be released only after shear forces are reduced.

Figure 4A:
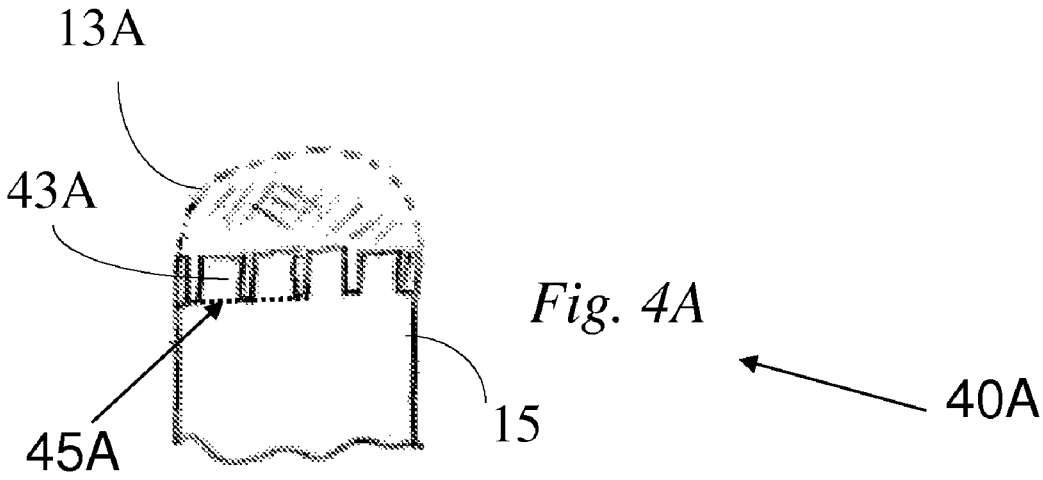
FIGS. 4A and 4B are perspective views of a non-lethal projectile, according to an embodiment of the present invention.
Figure 4B:
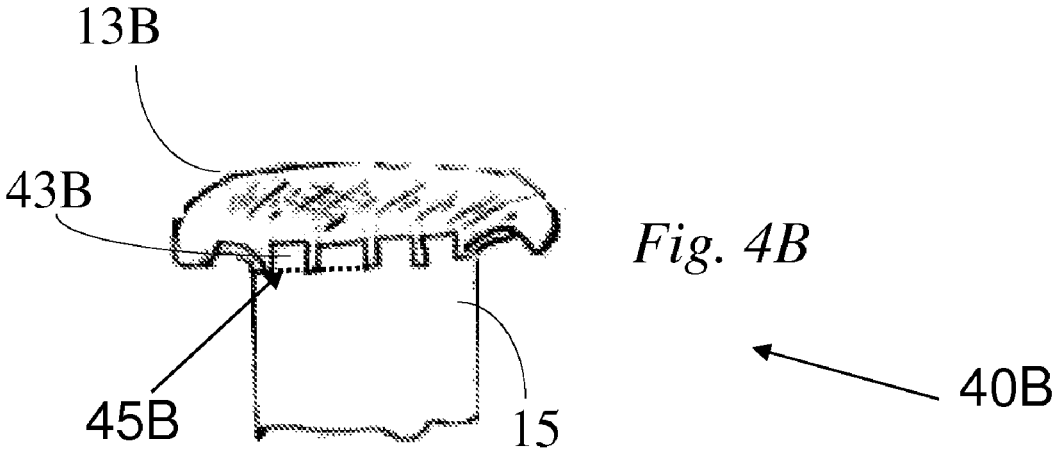

Reference is now made to FIG. 4, a perspective view of a non-lethal projectile 40, according to an embodiment of the present invention. FIG. 4A illustrates non-lethal projectile 40A prior to impact and FIG. 4B illustrates non-lethal projectile 40B after impact. A semi-rigid support element 43 contains at least part of the deformable material of deformable head 13. Semi-rigid support element 43 folds outward to some degree at or near fold line 45. Semi-rigid support element 43 preferably folds outward due to the pressure, enhancing the outward flow of the deformable material of deformable head 13 and increasing the contact area during impact. Alternatively, during impact semi-rigid support element 43 is bent (FIG. 4B) by the pressure and outward shear flow of the deformable material of deformable head 13. According to different embodiments of the present invention semi-rigid support element 43 may be part of main body 15 or a distinct part attached thereto. Semi-rigid support element 43 can be continuous or partial along the perimeter of main body 15 or with variations in rigidity along the perimeter to accommodate for control the shear flow on impact of the deformable material.

Figure 5A:
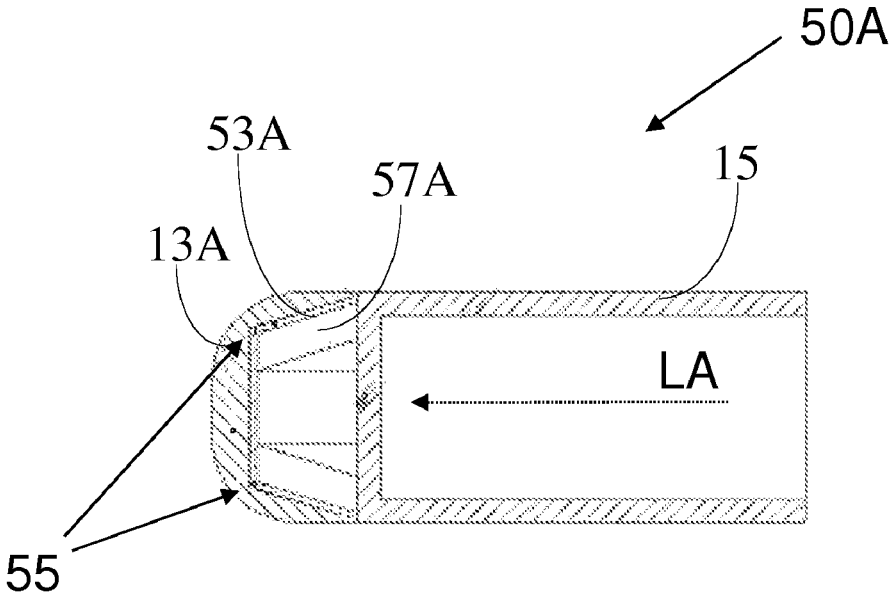
FIGS. 5A and 5B are side views in cross section of a non-lethal projectile, according to an embodiment of the present invention.
Figure 5B:
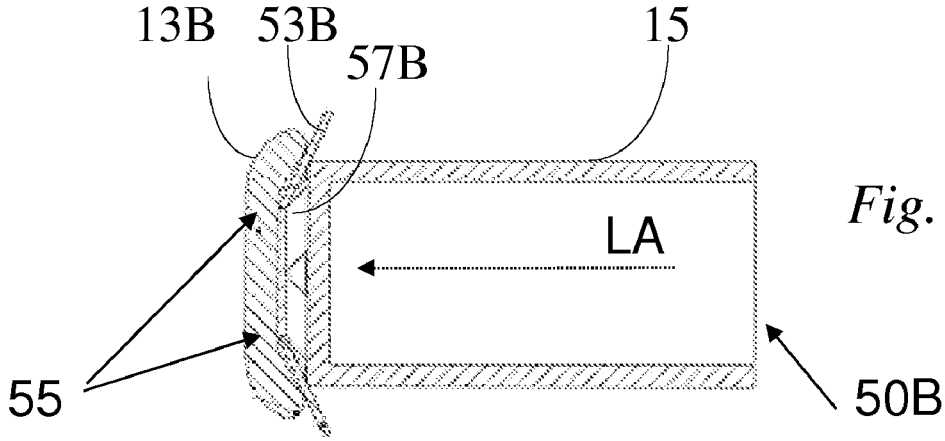

Reference is now made to FIG. 5, a side view in cross section of a non-lethal projectile 50, according to an embodiment of the present invention. FIG. 5A illustrates non-lethal projectile 50A prior to impact and FIG. 5B illustrates non-lethal projectile 50B at an intermediate point after impact. A semi-rigid support element 53 supports the deformable material of deformable head 13A. Typically, between semi-rigid support element 53 and main body 15, there is an air space 57A or soft material 57A. Semi-rigid support element 53 unfolds outward to some degree at or near fold lines or hinges 55. Semi-rigid support element 53 preferably unfolds outward due to the impact, enhancing the outward flow of the deformable material of deformable head 13 and increasing the contact area during impact. The bending or moving outward of support element 53 preferably increases the impact area by 20% or 30% or more, and thus decreases the pressure on the target. Air space and/or soft material 57B is of minimal volume after impact; most of the air/soft material 57A is forced to flow out by the impact. Although semi-rigid support element 53 is shown with three segments and two fold lines or hinges 55, it is readily apparent to one skilled in the art of mechanical design that similar embodiments of the present invention may be designed and constructed with semi-rigid support element 53 with one fold 55 and two segments, three folds 55 and four segments etc. Folds or hinges 55 can be an integral hinge or a weakened bent strip of semi-rigid support element 53 so that relatively low force causes the segments of semi-rigid support element 53 to align under impact.

When projectile 50 hits target 11 there is contact between target 11 and deformable head 13. As the middle segment is forced by the pressure to moves toward main body 15, the outer segments unfold with an outward motion. As a result, the cross sectional area of projectile 50 is increased on impact and the area cross-sectional area of the deformed material of deformable head 13.

Semi-rigid support element 43 or 53 in different embodiments preferably folds elastically and/or plastically or a combination of both elastic and plastic deformation.

Figure 6A:
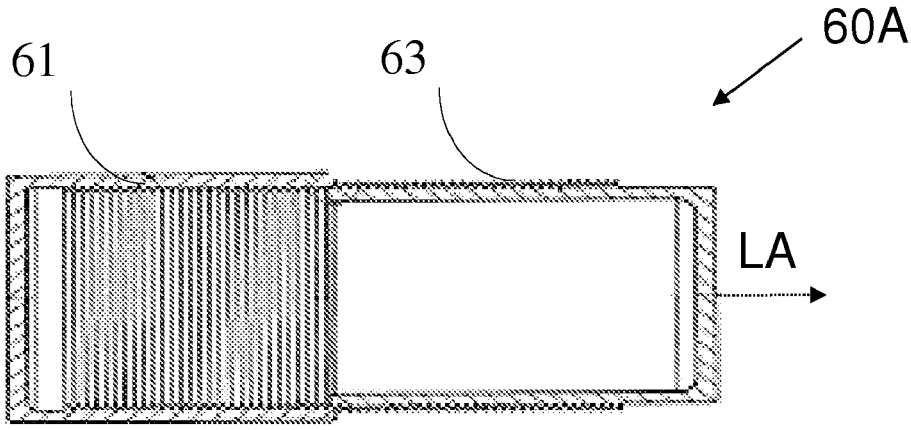
FIGS. 6A and 6B are side views in cross section of a non-lethal projectile, according to an embodiment of the present invention.
Figure 6B:
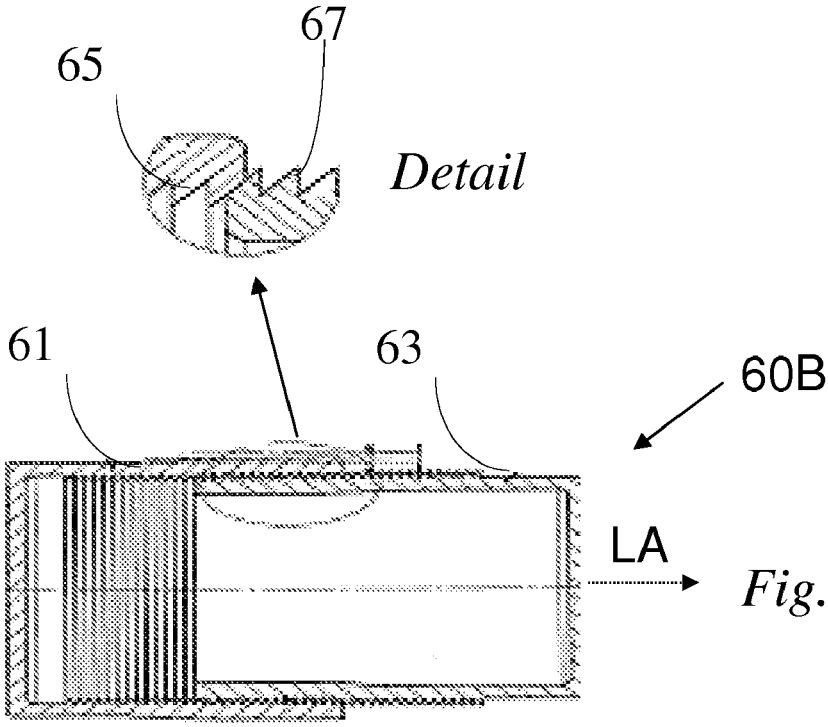

Reference is now made to FIG. 6, a side view in cross section of a non-lethal projectile 60, according to an embodiment of the present invention. FIG. 6A illustrates non-lethal projectile 60A prior to impact and FIG. 6B illustrates non-lethal projectile 90B after impact. Projectile 60 includes two main bodies 61 and 63 in which 61 is hollow and 63 fits inside only when bodies 61 and 63 elastically and/or plastically strained radially (perpendicular to the longitudinal axis LA). The head of non-lethal projectile 60 is not shown in FIG. 6. Non-lethal projectile preferably includes one or more embodiments (10, 20, 30, 40, 50) of deformable head or otherwise a conventional head. Non-lethal projectile 60 is launched in the direction of the arrow along longitudinal axis LA. On impact with target 11, body 61 is forced into body 63 by the force of the impact and the overall length (along axis LA) is reduced on impact. The more massive of bodies 61 and 63 is preferably in the rear, in this case body 61 is in the rear in non-lethal projectile 60. According to a preferred embodiment of the present invention bodies 61 and 63 are configured with interlocking toothed ridges 65 and 67. (see detail) herein referred to simply as "teeth". The ridges are formed on the inside diameter face of part 61 and on the outside diameter face of part 63 As seen in Detail, the outside diameter of part 63 is larger than the inside diameter of part 61 Also as seen best in Detail A, the teeth are preferably configured with a single sloped face and a substantially perpendicular face such that the sloped faces of the teeth of part 61 engage the sloped faces of the teeth of part 63. Therefore, as the two parts are forced together upon impact, the geometry of the teeth forces the diameter of part 61 to increase and the diameter of part 63 to decrease and thereby create radial stress. After parts 61 and 63 have reached their maximum deformation while passing over the raised teeth, they fall radially into the valley between the teeth without inducing any axial force. As the teeth fall into corresponding valleys, the perpendicular faces prevent any axial expansion of the two parts in the direction of longitudinal axis LA, and lock parts 61 and 63 in place. Friction between toothed ridges 65, 67 absorb part of the kinetic energy.

Figure 7:
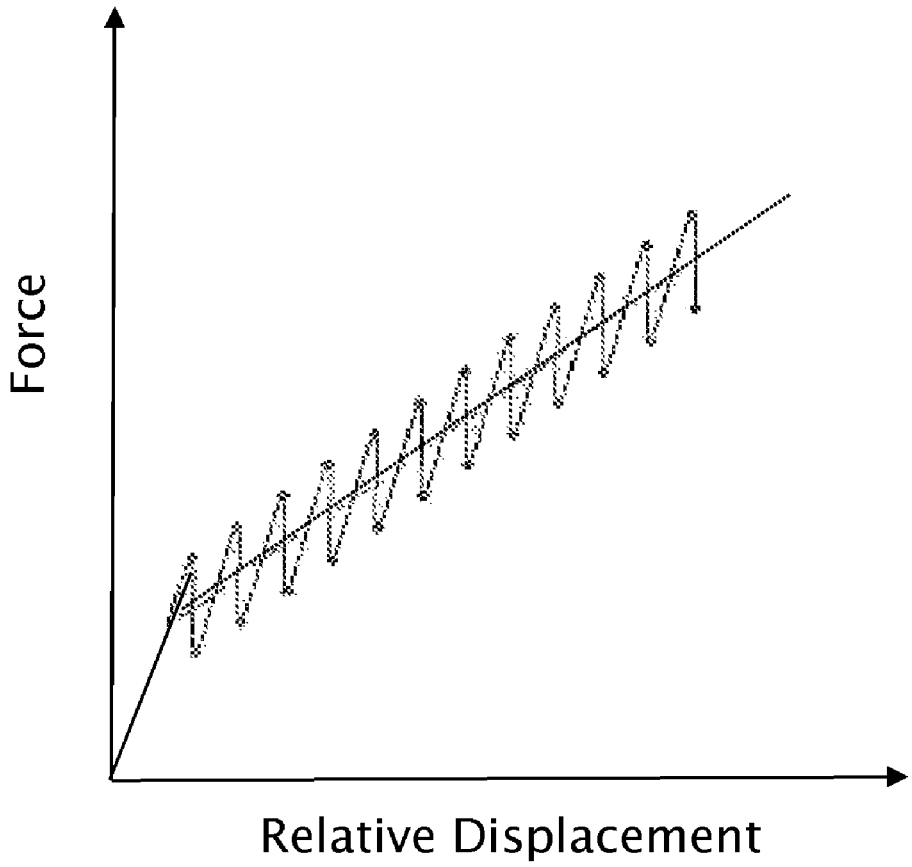
FIG. 7 is a typical graph of force against relative displacement for the non-lethal projectile of FIG. 6.
Figure 8A:
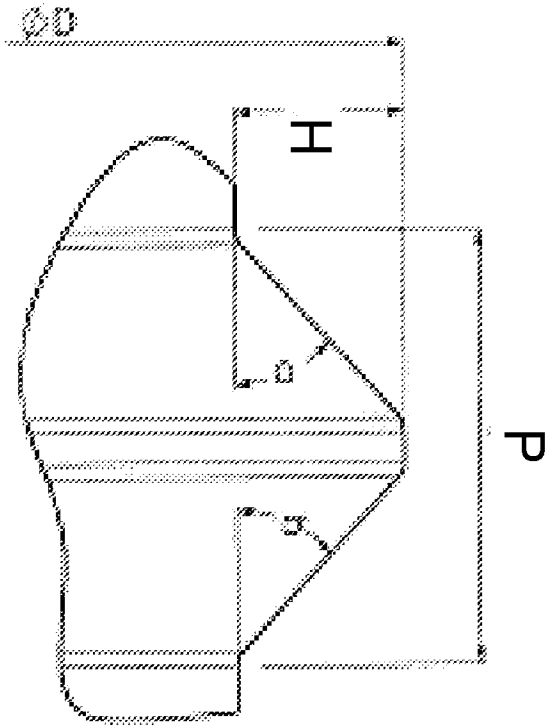
FIGS. 8A and 8B illustrate some of the important parameters for the design of toothed ridges, in accordance with embodiments of the present invention.
Figure 8B:
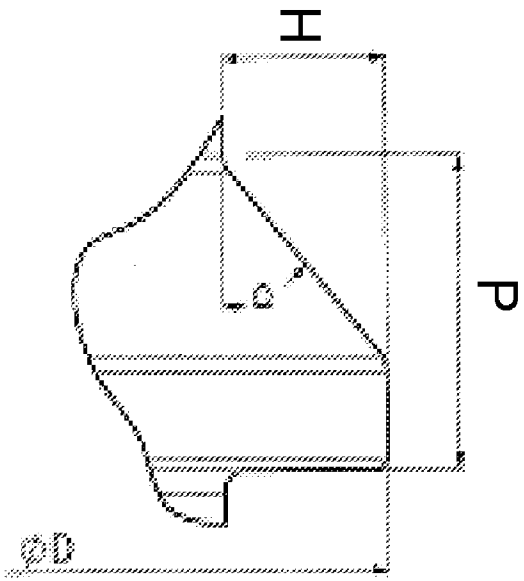

Reference is now made to FIG. 7 which includes a typical graph of force as required to displace bodies 61 relative to 63 using non-lethal projectile 60. Reference is now also made to FIG. 8A which illustrates some of the important parameters for the design of toothed ridges 65, 67 in accordance with embodiments of the present invention. Parameters include the height H of toothed ridges 65, 67, the width P (related to number of teeth per inch) and angles a and b. In FIG. 8B, a design of toothed ridge 65, 67 includes a slope a on one face of the ridge and the second face is substantially perpendicular as in the detail of FIG. 6. It will be understood, that the number of teeth per inch, the height of the teeth, the angles a and b and other parameters may be varied according to the needs of a specific application. The chosen surface materials for bodies 61 and 63 determines the friction coefficient between them.

Figure 9A:
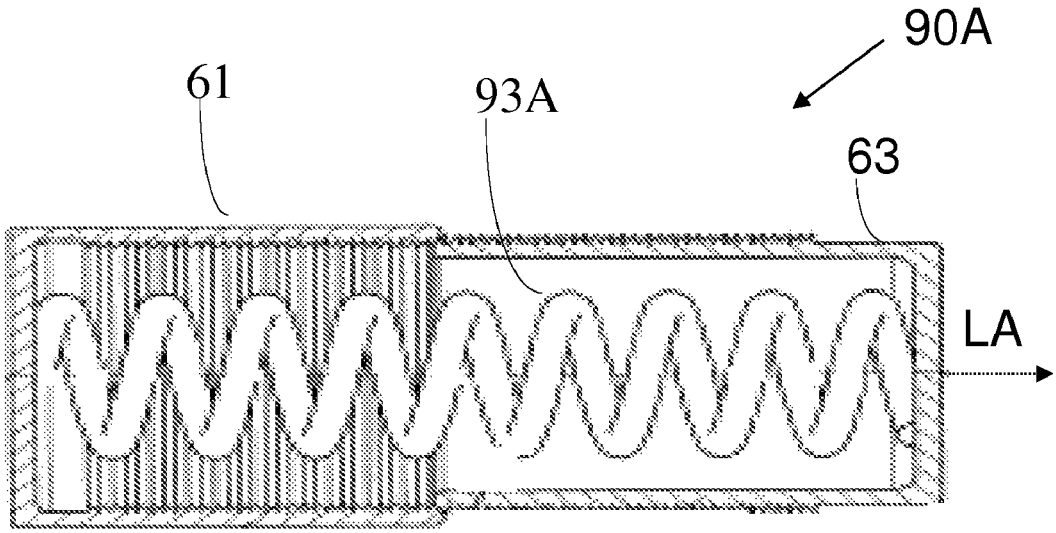
FIGS. 9A and 9B are side views in cross section of a non-lethal projectile, according to an embodiment of the present invention.
Figure 9B:
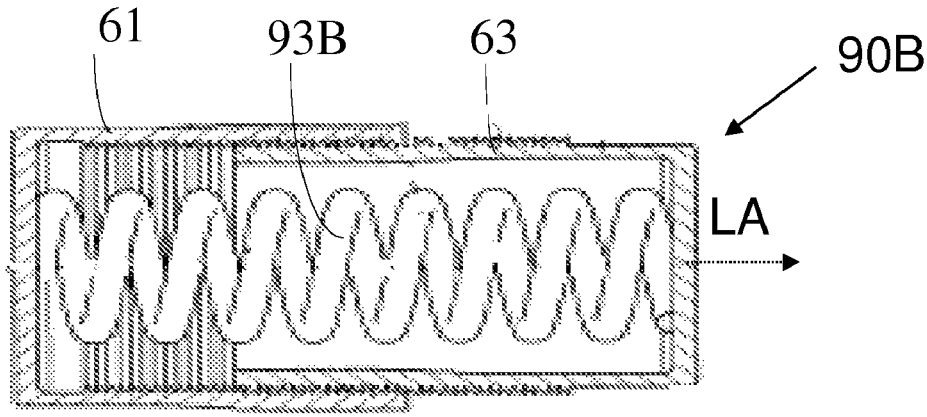

Reference is now made to FIG. 9, a side view in cross section of a non-lethal projectile 90, according to an embodiment of the present invention. FIG. 9A illustrates non-lethal projectile 90A prior to impact and FIG. 9B illustrates non-lethal projectile 90B after impact. As in projectile 60, projectile 90 includes two main bodies 61 and 63 in which 61 is hollow and 63 fits inside. Optionally, bodies 61, 63 are constructed to be elastically strained radially (perpendicular to the longitudinal axis LA). The head of non-lethal projectile 90 is not shown in FIG. 9. Non-lethal projectile 90 preferably includes one or more embodiments (10, 20, 30, 40, 50) of deformable head or otherwise a conventional head. Non-lethal projectile 90 is launched in the direction of the arrow along longitudinal axis LA. On impact with target 11, body 61 is forced into body 63 by the force of the impact and the overall length (along longitudinal axis LA) is reduced on impact. The more massive of bodies 61 and 63 is preferably in the rear, in this case body 61 is in the rear in non-lethal projectile 90. A spring element 93 is assembled between bodies 61 and 63. If no interlocking is applied then the potential energy in the spring is translated to additional force on the target. This force is exerted subsequently after the initial impact. According to a preferred embodiment of the present invention bodies 61 and 63 are configured with interlocking toothed ridges 65 and 67.

Figure 10:
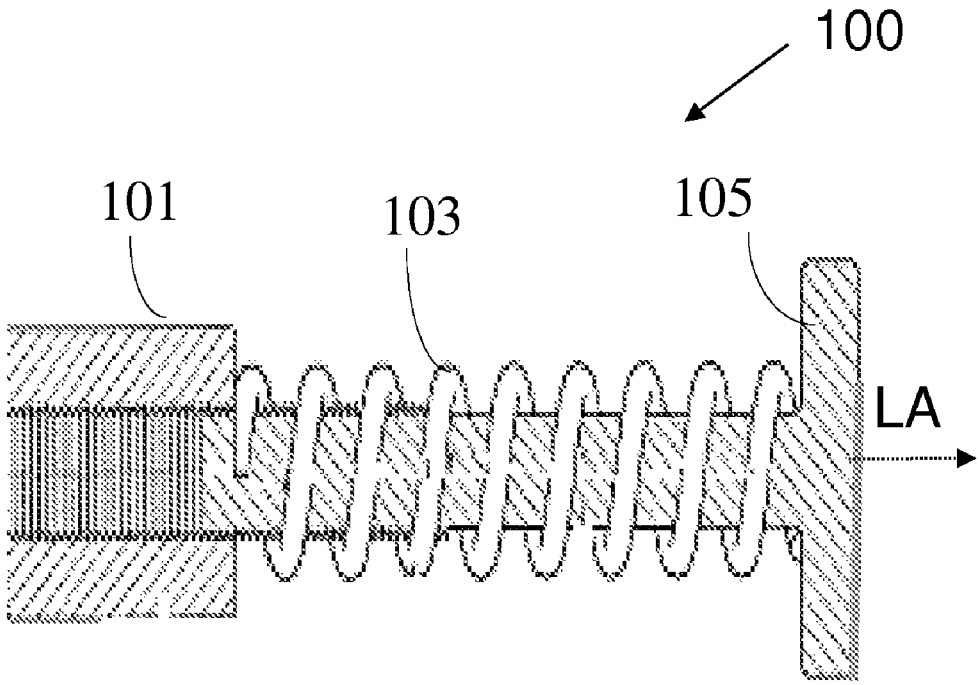
FIG. 10 is a side view in cross section of projectile, according to a variation of embodiment of FIG. 9, of the present invention.

Reference is now made to FIG. 10 which illustrates a side view in cross section of projectile 100, according to an embodiment of the present invention which is a variation of projectile 90. Two bodies 101 and 105 of projectile 100 are shown. The head of non-lethal projectile 90 is not shown in FIG. 10. Non-lethal projectile 100 preferably includes one or more embodiments (10, 20, 30, 40, 50) of deformable head or otherwise a conventional head. A spring element 105 is assembled between parts 101 and 105. Body 101 is hollow and optionally body 105 marginally fits into 101 only when bodies 101 and 105 are elastically strained radially (perpendicular to the longitudinal axis LA) Non-lethal projectile 100 is launched in the direction of the arrow along longitudinal axis LA. On impact with target 11, body 105 is forced into body 101 by the force of the impact and the overall length (along longitudinal axis LA) is reduced on impact. The more massive of bodies 105 and 101 is preferably in the rear, in this case body 61 is in the rear in non-lethal projectile 90. According to a preferred embodiment of the present invention bodies 105 and 101 are configured with interlocking toothed ridges 65 and 67. A spring element 103 is assembled between bodies 101 and 105. During impact of projectile 100, some of the kinetic energy of projectile 100 is stored in spring element 103 because of the forward inertia of body 101. When a locking mechanism, e.g. toothed ridges, is applied then spring element 103 does not relax after compression on impact because of the action of the locking mechanism. Otherwise, if the locking mechanism is not applied, a portion of the energy stored in spring 103, transfers more energy to target 11 by pushing bodies 101, 105.

The foregoing discussion of various embodiments of the present invention is illustrative only. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Although embodiments of the present invention have been shown and described, it is to be appreciated that variations, modifications, and other applications may be made to these embodiments without departing from the principles and spirit of the invention, the scope of which is defined in the claims and their equivalents.

What is claimed is:

1. A projectile for use in a non-lethal weapon system, the projectile comprising:

(a) a first body and a second body with a longitudinal axis, wherein the projectile is configured to be launched substantially along said longitudinal axis towards a target; and (b) an elastic mechanism disposed between said first and second bodies, wherein upon impact of the projectile with said target, said elastic mechanism is adapted to absorb elastically a first portion of the kinetic energy of the projectile;

(c) a locking mechanism which stores said first portion of said kinetic energy within said elastic mechanism, wherein said second body includes a hollow, wherein a portion of said first body fits marginally within said hollow; wherein said first body is externally ridged with a plurality of first ridges and said hollow is internally ridged with a matching plurality of second ridges, and while said first body is forced into said hollow during said impact, said locking mechanism is adapted to lock said first ridges on said second ridges, wherein said first ridges and second ridges are shaped to prevent release of said elastic mechanism.

2. The projectile, according to claim 1, wherein said elastic mechanism includes a spring which is deformed upon said impact, and stores elastically said first portion of the kinetic energy.

3. The projectile, according to claim 1, wherein while said first body is forced into said hollow during said impact, and said elastic mechanism includes an elastic deformation of at least one of said first body or said second body.

4. The projectile, according to claim 1, wherein said elastic mechanism on said impact absorbs elastically said first portion of the kinetic energy which is stored elastically as stored energy within said elastic mechanism, and then during said impact with said target said elastic mechanism releases at least part of said stored energy to said target thus extending the impulse duration.

5. The projectile, according to claim 1, further comprising (d) a frictional mechanism which dissipates a second portion of the kinetic energy as energy of kinetic friction between said first body and said second body.

* * * * *